US006021974A

United States Patent [19]

Koskelainen

[11] Patent Number: 6,021,974

[45] Date of Patent: Feb. 8, 2000

[54] WINDING ARRANGEMENT FOR COILING OF AN ELONGATED FLEXIBLE ELEMENT AND COILING MEANS

[75] Inventor: Erkki Koskelainen, Axel Berggrens gata 6, S-511 63, Skene, Sweden

[73] Assignee: Erkki Koskelainen, Skene, Sweden

[21] Appl. No.: 08/849,294

[22] PCT Filed: Dec. 1, 1995

[86] PCT No.: PCT/SE95/01445

§ 371 Date: Jul. 29, 1997

§ 102(e) Date: Jul. 29, 1997

[87] PCT Pub. No.: WO96/16890

PCT Pub. Date: Jun. 6, 1996

[30] Foreign Application Priority Data

Dec. 2, 1994 [SE] Sweden ..... 9404187

[51] Int. Cl.[7] ..... B65H 16/02

[52] U.S. Cl. ..... 242/593; 242/609.2; 242/608.4; 242/604.1; 242/118.62

[58] Field of Search ..... 242/593, 609.2, 242/608.4, 118.62, 472.5, 604, 604.1, 128, 129

[56] References Cited

U.S. PATENT DOCUMENTS

| | | | |
|---|---|---|---|
| 877,397 | 1/1908 | Brinley | 242/608.4 |
| 1,171,545 | 2/1916 | Sands | 242/604 |
| 1,669,451 | 5/1928 | Brandwood | 242/118.1 |
| 1,915,825 | 6/1933 | Hescock | 242/608.4 |
| 2,158,994 | 5/1939 | Bureau | 242/608.4 |
| 2,161,543 | 6/1939 | Wandrey | 242/607 |
| 2,452,378 | 10/1948 | Hudson | 242/608.1 |
| 2,709,553 | 5/1955 | Wellcome | 242/470 |
| 2,936,133 | 5/1960 | Casey et al. | 242/577.4 |
| 2,990,135 | 6/1961 | Croteau et al. | 242/129 |
| 3,584,809 | 6/1971 | Ogden, Sr. | 242/129 |
| 4,066,224 | 1/1978 | Hargreaves et al. | 242/608.4 |
| 4,140,289 | 2/1979 | Kovaleski | 242/118.6 |
| 4,687,151 | 8/1987 | Memminger et al. | 242/420.5 |
| 4,913,369 | 4/1990 | Lia et al. | 242/405.2 |
| 5,025,999 | 6/1991 | Littrell | 242/577 |
| 5,100,078 | 3/1992 | Clark | 242/171 |
| 5,104,057 | 4/1992 | Chesler et al. | 242/128 |
| 5,465,917 | 11/1995 | Kosch | 242/128 |
| 5,522,561 | 6/1996 | Koyamatsu et al. | 242/178 |
| 5,605,305 | 2/1997 | Picton | 242/608 |
| 5,934,606 | 8/1999 | Guild | 242/608.4 |

*Primary Examiner*—Donald P. Walsh
*Assistant Examiner*—Minh-Chau Pham
*Attorney, Agent, or Firm*—Dvorak & Orum

[57] ABSTRACT

A coiling system for coiling and uncoiling of the elongated flexible element. The elongated flexible element is preformed and coiled onto a core, which is detachable for the purpose of uncoiling the elongated flexible element by its inner end. A coiling system which comprises a coil component functioning as an end wall so arranged as to interact with a detachable core with an elongated flexible element coiled thereonto.

9 Claims, 5 Drawing Sheets

101B
101
51

107
CL
52
50
56
57
104
112
106
110
60
101A 108
106
103

107
110A
104
110
112
X
101
101A
62
60
61
61

WINDING ARRANGEMENT FOR COILING OF AN ELONGATED FLEXIBLE ELEMENT AND COILING MEANS

BACKGROUND OF THE INVENTION

The present invention relates to a coil system for coiling of an elongated flexible element, such as a cable, line, rope, hawser, wire or hose, and for uncoiling of the elongated flexible element, in conjunction with which the elongated flexible element is coiled onto a core, which is detachable for the purpose of uncoiling the elongated flexible element by its inner end.

A number of different systems is known for laying optical cables and other types of cables and lines in the ground, and all of these have their advantages and disadvantages. Technical and/or geographical obstacles affect the manner of proceeding with this, and one technical obstacle that can be mentioned is the inability of the equipment to draw, i.e. to feed or blow, the optical cable for the whole of the intended distance. It is then necessary to resort to so-called looping, which is difficult as a rule, especially when long lengths are involved. The majority of projects for which cables are required to be laid in the ground also require looping. There is also a risk of the cable suffering damage if it is left lying above the ground for a long time. The need thus exists for a new coil system which, amongst other things, enables the above-mentioned problem to be solved.

There is also a wish to be able to wind on a certain length of the desired elongated flexible element of the kind referred to above, which is capable of being uncoiled from an intended coil by both internal and external uncoiling and without twinning the elongated flexible element. For example, it must be possible for a length of cable to be uncoiled and drawn out in each of two directions, which are mutually opposite to one another, from a centrally located uncoiling point, without the need to move the coil.

Previously disclosed via JP,A, 53-114083 is a coil system for cables, in which a conically executed core is removable for the purpose of uncoiling the cable by its inner end. An external guard around the wound-on cable coil prevents unwinding of the cable by its outer end. Uncoiling from the inside only is permitted in this way, which requires the use of a machine that rotates the coil and guides the cable as it is uncoiled, so that it does not twist. The core must also be conical, which means that the space available for winging-on the cable is reduced compared with that of a constant core diameter.

Optional uncoiling from the coil is thus not permitted, and in addition special arrangements are required in the case of uncoiling from inside the centre of the coil.

SE-B-469228 relates to the packing of cable inside a case which exhibits a cover and a base, with the cable wound around a shaft. The cable is fed out from the inside via an opening in the cover. Winding-on of the cable takes place around a circular core, which is subsequently removed in conjunction with packing of the coil. Only the packing case with its cover then serve to hold together the resulting cable coil, which excludes the possibility of optional feeding-out of the cable by its internal or external end.

U.S. Pat. No. 4,580,399 describes a coil system in which a cable is wound onto a cylindrical core, in which case uncoiling must take place in a special fashion in an axial direction in order to prevent twisting of the cable. Internal uncoiling requires a conical core, which is drawn out at least for a certain distance before uncoiling from the inside in an axial direction. This arrangement does not permit optional uncoiling from the inside or from the outside of one and the same coil.

SUMMARY OF THE INVENTION

The principal object of the present invention is, therefore, to solve the above-mentioned problems by simple, yet efficient means.

Said object is achieved by means of a coil system in accordance with the present invention, which is characterized essentially in that a connection in the form of rods or tubes extending along the coil of a pre-formed coiled elongated element is so arranged as to be capable of application in such a way as to hold together the coil and thus to be retained during uncoiling of the elongated flexible element, in conjunction with which at least one end wall of the coil is so arranged as to interact with the core for uncoiling the elongated flexible element by its outer end and, with the external coil connection, for uncoiling the elongated flexible element by its inner end.

A further object of the invention is to find coiling means for this purpose which are capable of being applied in conjunction with a coil system in accordance with the present invention.

Said further object is achieved by means of a coiling means in accordance with the present invention, which is characterized essentially in that the core, which is formed from rods or tubes, is detachably attachable to at least one end wall radially displaced from an intended coil space for the elongated flexible element, both internally and externally around said coil space.

DESCRIPTION OF THE DRAWINGS

The invention is described below as a number of preferred illustrative embodiments in conjunction with optical cables, although the invention can be applied equally to other kinds of flexible cables, lined and other elongated flexible elements. Reference is also made at this point to the accompanying drawings, in which

FIGS. 6–9 show a further embodiment of a coil and its application, in conjunction with which FIG. 6 shows a coil with simultaneous uncoiling from the outside and the inside, FIG. 7 shows the coil arranged for drawing out by its inner end, FIG. 8 shows only the coil empty, and FIG. 9 shows the coil wound for uncoiling by its outer end.

DETAILED DESCRIPTION

Figure 3:
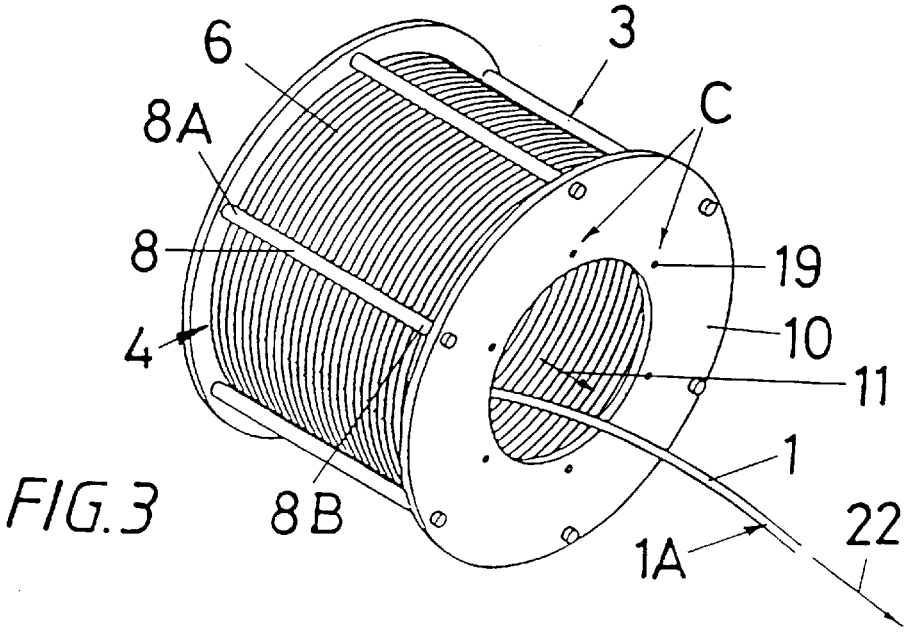
FIG. 3 shows a perspective view of a cable coil ready for drawing out by its inner end.
Figure 4:
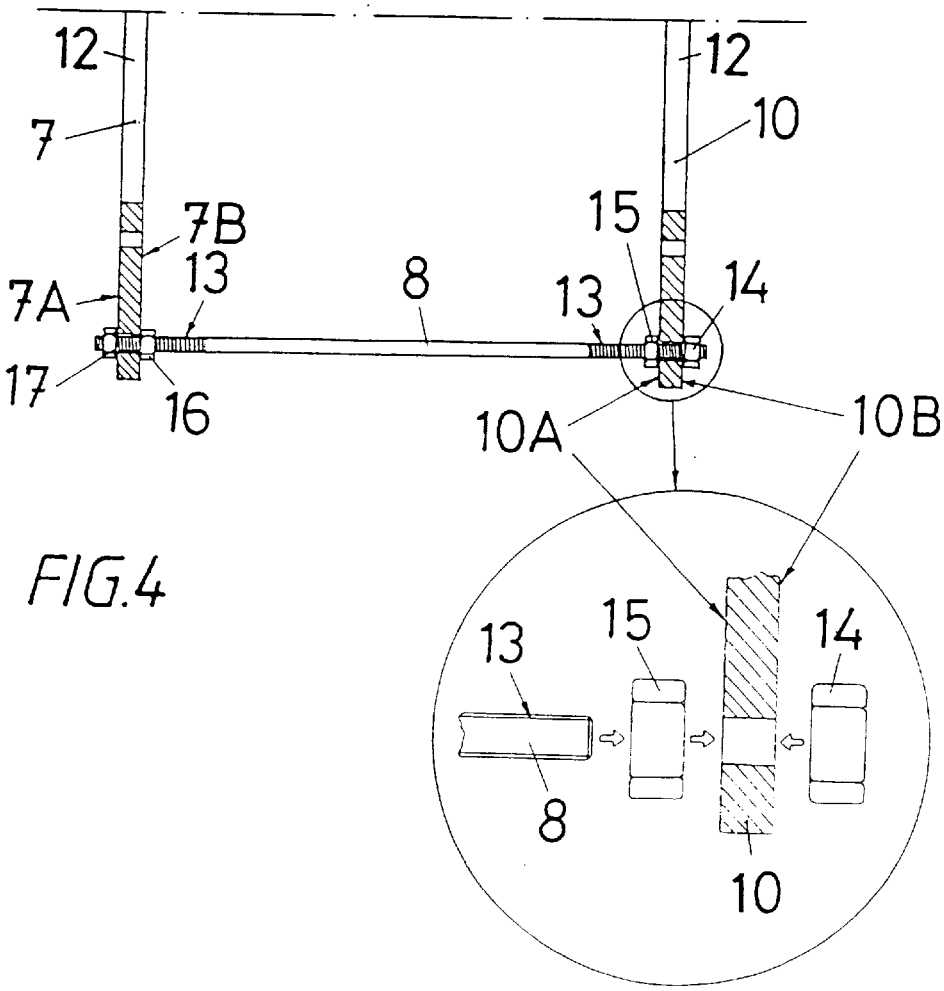
FIGS. 4 and 5 show variants of core components.
Figure 5:
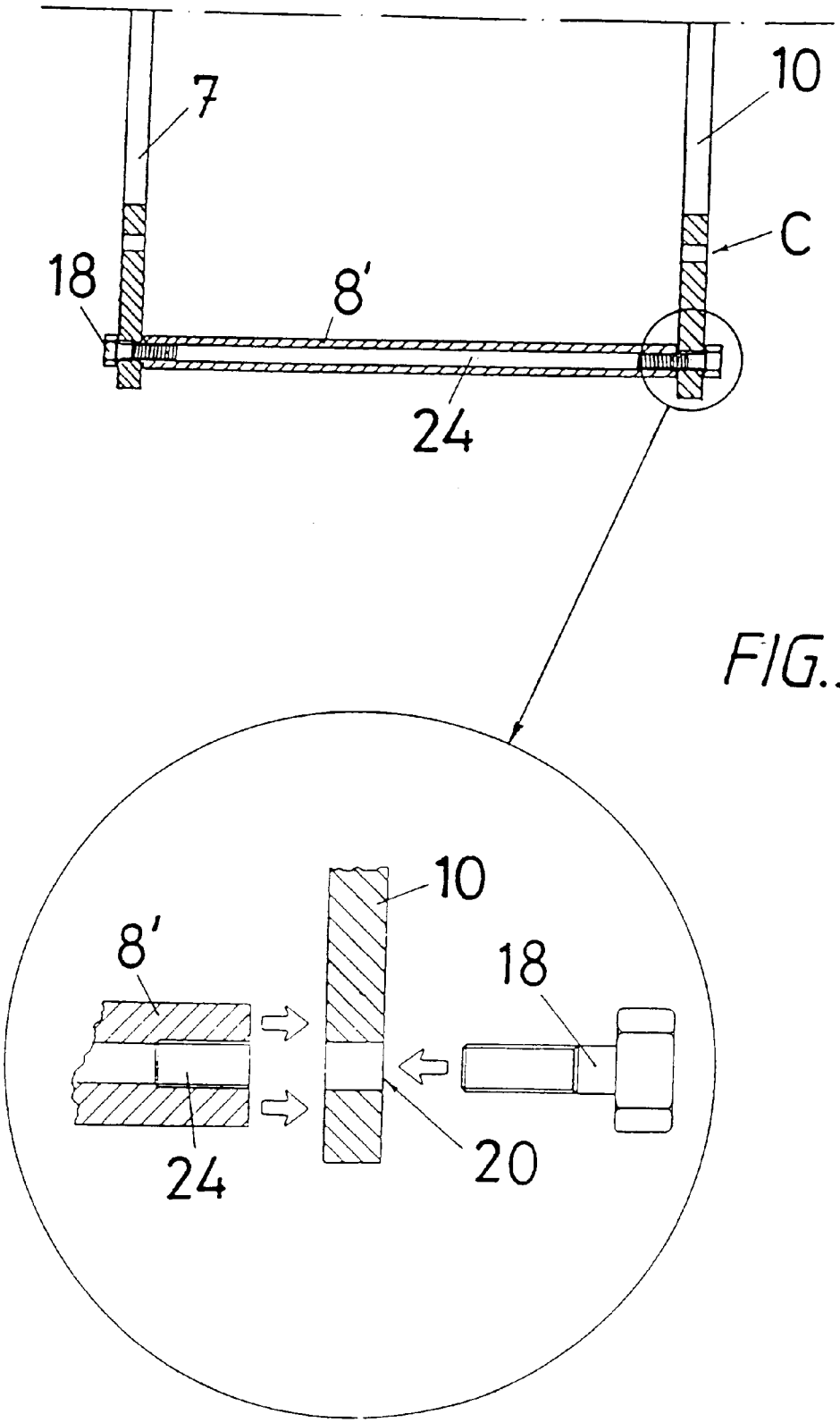

In accordance with the invention, a coil system for the coiling of, for example, a cable 1 or some other elongated flexible element, and for uncoiling the cable 1, etc., for the purpose of enabling the work of looping to be mechanized and allowing the cable, etc., to be uncoiled as it is drawn out, but without rotation of the winding drum used in conjunction with coiling, involves the cable, etc., 1 being performed and coiled onto a core 2, which is detachable in the manner illustrated in FIG. 3 for the purpose of uncoiling the cable 1, etc., by its inner end.

More specifically, a connection 3 for a coil 4 formed in accordance with the aforementioned system is so arranged as to extend along a coiled cable coil 6 externally around same. Said connection 3 is so arranged as to be capable of application in such a way as to hold together the coil 4 and thus to be retained during uncoiling of the cable 1, etc., by its inner end, as shown in FIG. 3.

It is thus a realistic expectation to be able to improve handling of the cable with regard to quality and, at the same time, to achieve advantages due to the rationalization that the coil system offers.

In fact, testing of the system has been carried out in secrecy, and the control measurements on the cable and its thin conducting fibres were carried out during and after laying and handling of the cable. No harmful changes were revealed by the testing.

It is accordingly now possible to achieve rolling-up of, for example, an optical cable 1 by performing the cable 1, namely through relative movement between the formed coil core 2 and a coiling arrangement 5 provided for this purpose. Said coiling arrangement 5 is rotatable about the coil core 2 with the cable 1 extending axially along a section A in relation to the core 2 before the cable 1 is fed for tangential delivery to the core 2, along a section B and also in relation to the intended and the formed cable coil 6, i.e. the cable skein which exhibits coiled form after winding onto the core 2.

Figure 1:
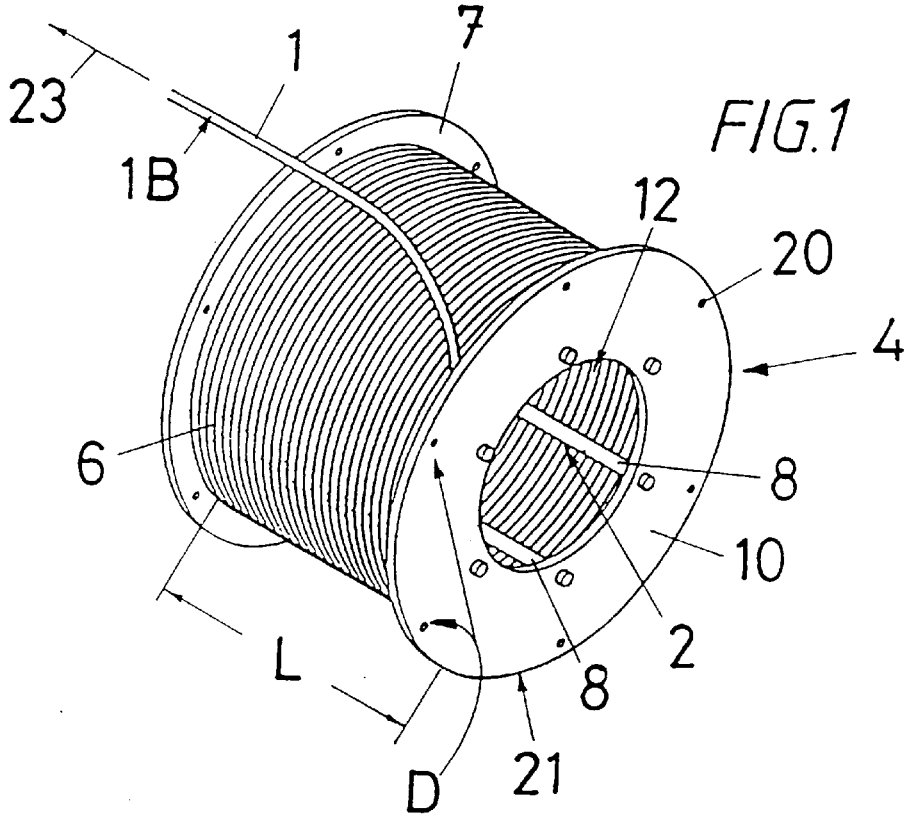
FIG. 1 shows a perspective view of a coil ready for drawing out by its outer end.
Figure 2:
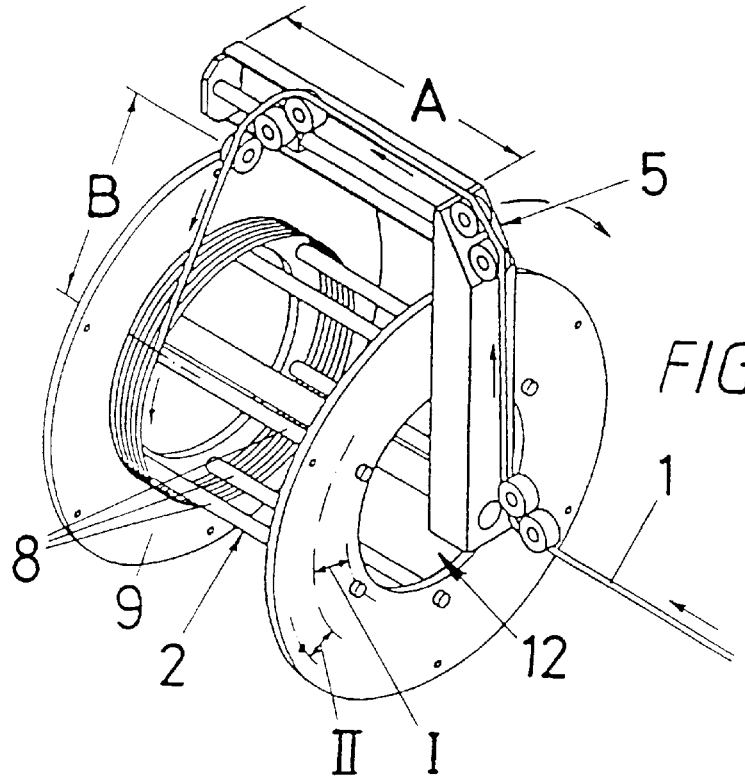
FIG. 2 shows a coiling apparatus during the coil winding phase of a cable.

Preferably at least one coil end wall 7 is so arranged as to interact respectively with said core 2 and the external coil connection 3 on the intended occasion, in order to permit uncoiling of the cable 1 by its inner and outer ends; see FIG. 1 and FIG. 3. The same element 8, or at least essentially similar elements 8, are appropriately used for this purpose, in order alternatively to form a core 2 and an external coil connection 3.

Said core 2 is thus formed preferably by an appropriate number of rods 8, for example six, as shown in the illustrative embodiment. Said rods 8 are arranged detachably attachable with at least one end wall 7 radially displaced for a distance I and II respectively, inwards and outwards respectively, from an intended coil space 9 for the cable 1, both internally and externally about said cable coil space 9.

In order to facilitate handling of the coil 4 and the cable 1, for example to permit the coil 4 to be capable of being rolled onto a supporting base, two end walls 7, 10 are so arranged as to be included as components of an intended coil 4, of which at least one end wall 10 exhibits a centrally situated and axially 11 extending inlet opening 12 for the cable 1, to permit drawing out by its inner end 1A from said coil 4. The two disc-shaped end walls 7, 10, which are preferably executed with circular peripheral form, are retained at a desired distance L from one another by means of said rods 8 functioning respectively as a core 2 and as an external coil connection 3.

Said rods 8 are capable of interacting with the end walls 7, 10 to permit their detachable attachment at a set distance L between the end walls 7, 10. The detachable attachment is preferably achieved by at least one end 8A of the rods, but preferably both ends 8A, 8B, exhibiting threaded devices 13 by means of which nuts 14–17 or some other securing device, for example a bolt 18, are so arranged as to be capable of interacting, for the purpose of retaining the end walls 7, 10 to the rods 8, with a nut on either side 7A, 7B; 10A, 10B of an end wall 7, 10 for securing them after having been introduced through an appropriate opening.

The end walls 7, 10 exhibit a number of receiving openings 19, 20 corresponding to the desired number of rods 8 distributed around the periphery of the end walls 7, 10. More specifically, a group C of openings 19 evenly distributed around the periphery of the end wall is present directly adjacent to the central opening 12 in the end wall. A group D of openings 20 is similarly present at the outer periphery of the end walls, directly adjacent to the outer peripheral edge 21 of the respective end wall. The openings 19, 20 are radially displaced from an intended coil space 9 for the cable 1, both internally and externally around said cable coil space 9.

In the case of fixing screws 18, it is sufficient to have one screw 18 at either end of a bar 8 or a tube 8', and identical screws 18 can be capable of being introduced into threaded holes 24 in a radial direction between end walls 7, 10 set at a pre-determined distance.

The function of the invention should have emerged from the embodiment described above, and by winding the optical cable 1 onto the detachable core 2 of the coil by pre-forming during the winding operation, the cable 1 can be drawn out without the coil drum 4 rotating. This permits uncoiling of the cable 1 from the coil drum by its inner end 1A and its outer end 1B without the need to apply tractive force, and the cable can be drawn out by pulling the intended cable end 1A, 1B in the direction 22, 23 of drawing out. The possibility thus exists for drawing out the cable 1 in two directions.

Optical cable 1 in long lengths is purchased and stored at a suitable location within the region. The coiling arrangement 5 is also located there. Accurate lengths can then be wound-on by the pre-forming method. This also means less wastage of optical cable 1. Coiling of 4000 metres of cable is estimated to take approx. 1 hour. The coiled drum and a simple stand are then transported to the laying site. A coiling arrangement adapted for use in the field is positioned in association with a final feeder along the laying distance. This is controlled together with the feeders and gradually uncoils the cable 1. This permits looping to be eliminated.

The economic benefits achieved from the introduction of the coil system include: an improvement in quality in conjunction with laying through the elimination of manual uncoiling, since manual uncoiling produces uneven uncoiling with the risk of jerking. A drum handler is no longer needed, nor are those persons who are concerned with looping, of whom a large number is sometimes required. The units achieved in this way are thus readily manageable.

Figure 6:
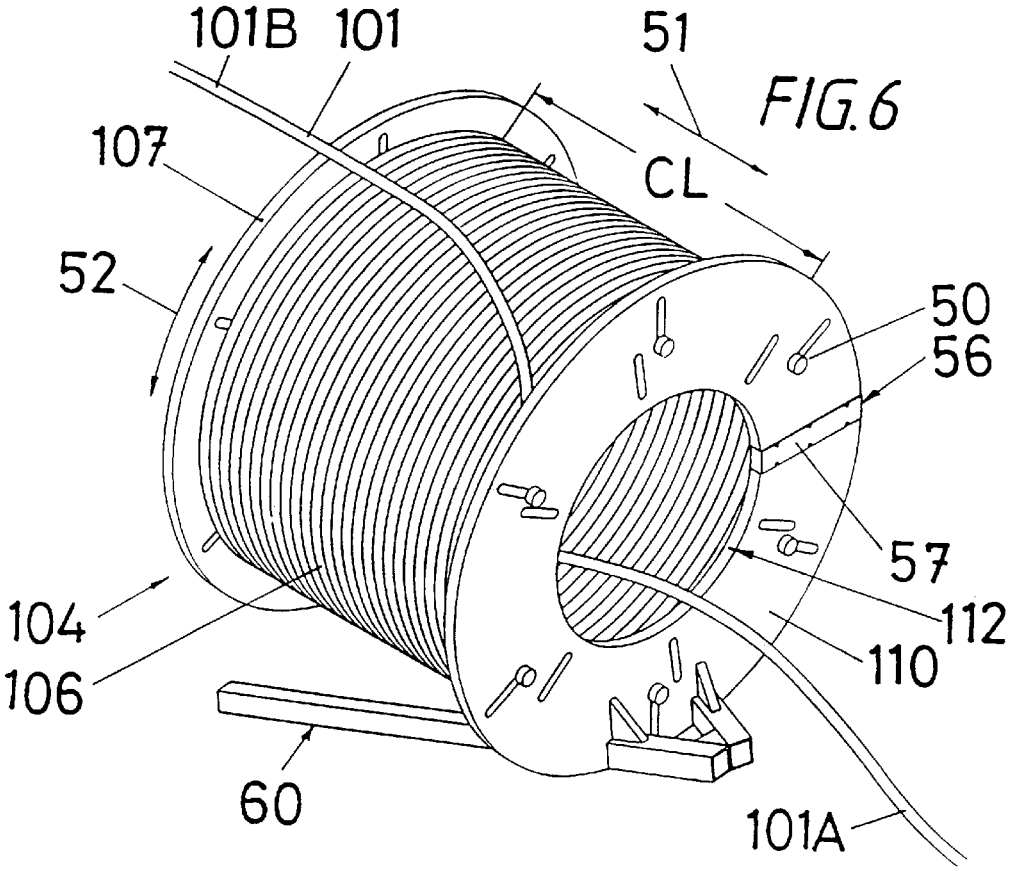

According to the second illustrative embodiment of the invention, the coil system can be seen from the drawings in FIGS. 6–9 to comprise a connection 50 displaced radially outwards from an internally located core 102—see specifically FIG. 6—which connection extend across 51 the intended winding direction 52 of the cable for the purpose of holding together two end wall sides 107, 110 situated at a mutual distance CL from another. Of said end wall sides 107, 110, at least one end wall side 110 is provided with an inlet opening 112 to permit uncoiling of a flexible elongated element 101 by its inner end through said opening 112. Said connection 50 is also so arranged as to be enclosed by an element 101 in the coil 106 coiled onto an intended core 102 by pre-forming.

Said connection 50 may consist of identical elements 108 to those from which the core 102 is constructed, for example bars, tubes or other reinforcing uprights.

Said connection 50 may be movably supported in essentially radially 53 oriented mounting slots 54, 55 in said end walls 107, 110. The elements 108 can also be formed from tubes, into which elongated, threaded, boltlike rods are capable of being introduced, onto which nuts are threaded outside the end walls for the purpose of holding them together.

The end wall 110 provided with a central opening 112 is also so arranged as to exhibit a through slot 56, or the end wall 110 is capable of being divided in some other appropriate way. A bridging element 57, which may consist of a plate, for example, and may be detachably attached to the end wall 110 for the purpose of bridging said slot 56, via which a cable 101, for example, may be passed in the event of the cable 101 being uncoiled respectively from the outside and from the inside of the coil, rather than being left hanging like a ring around the cable etc. 101.

A cable 101, for example, can thus be drawn out in desired lengths by positioning the aforementioned connection 50 at a distance selected radially from the core 102 in such a way that the length of the cable 101, which is situated to either side of said detachable connection 50, matches the distance for which it is wished that the cable shall extend, starting from the drawing-out point between the respective ends 101A, 101B of the cable.

The coil 104 can have radially displaced slot s 54, 55 enabling it to be adapted to accommodate the elements 108 in positions such as to form both a core 102, an intermediate connection 50 or an external connection 103.

Figure 7:
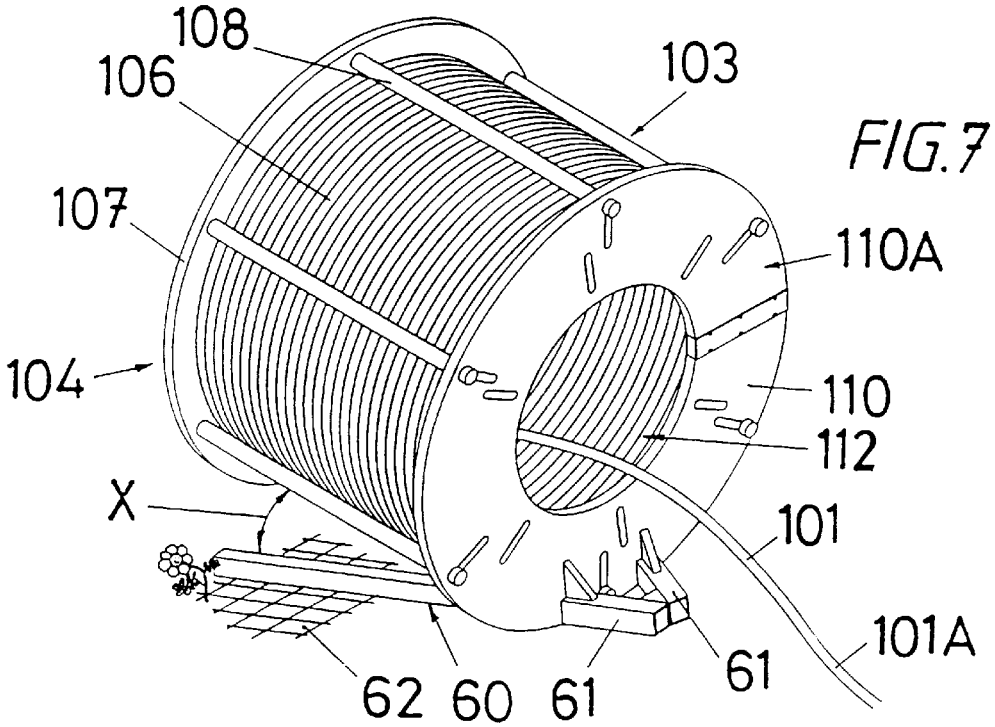
Figure 8:
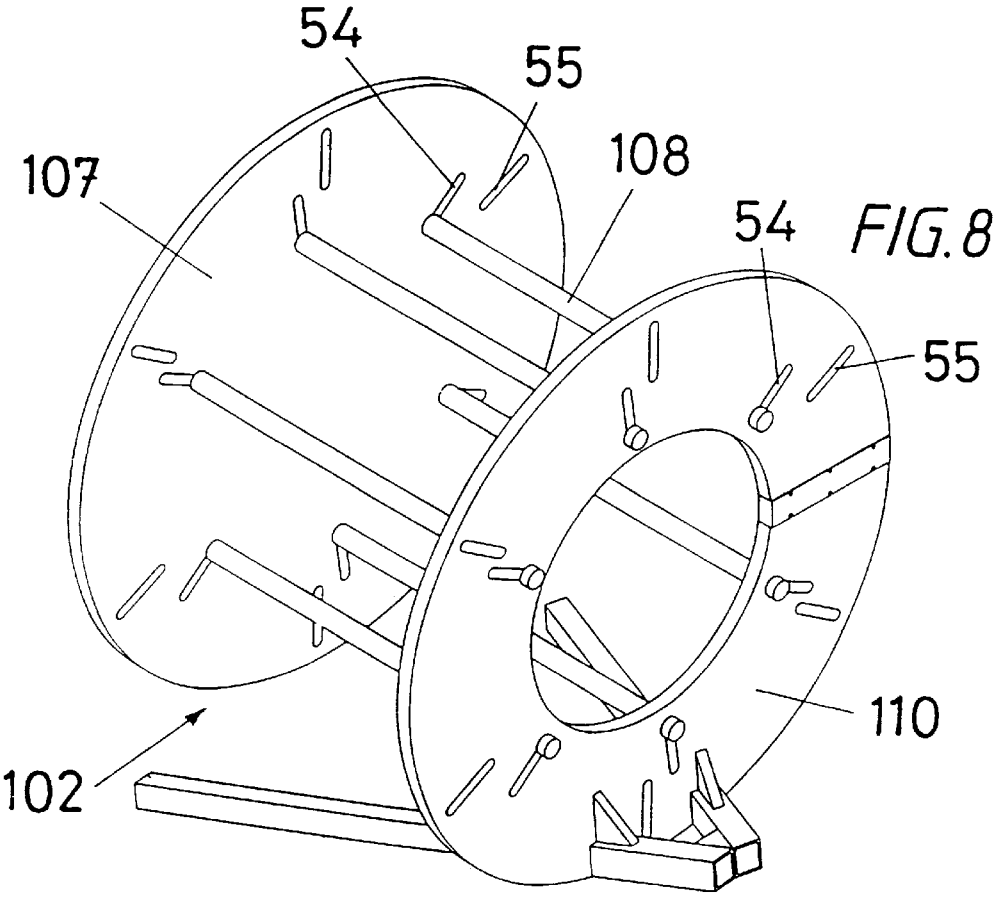
Figure 9:
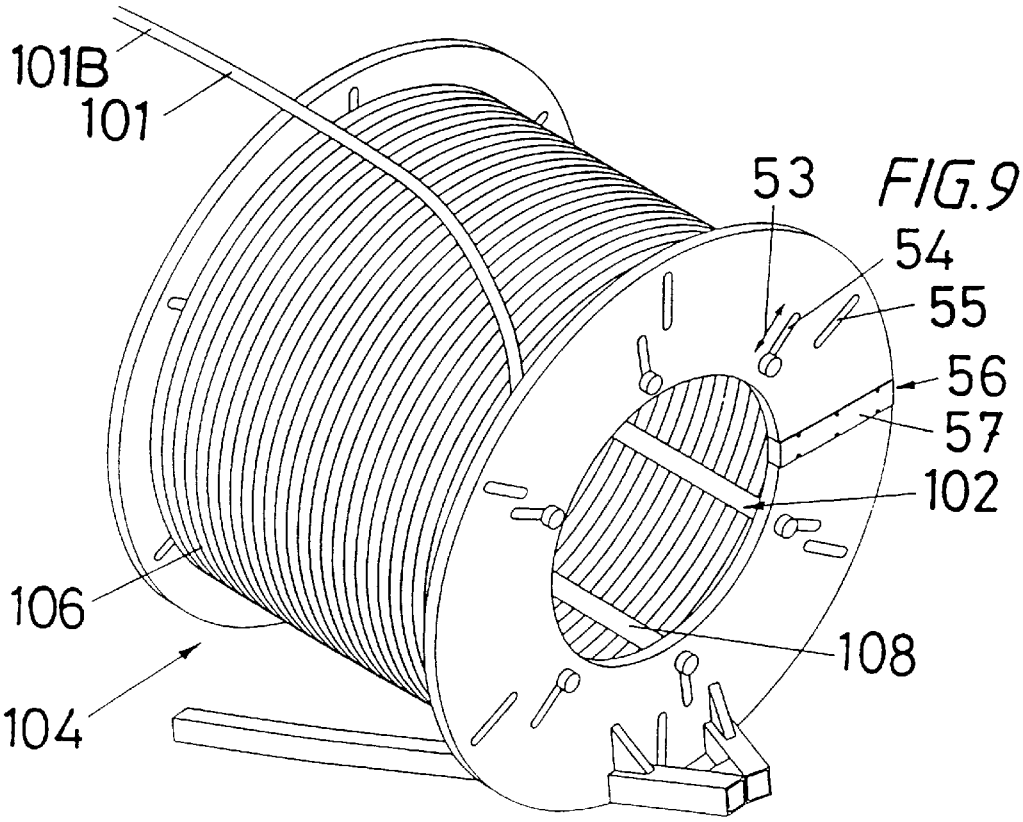

A support 60, which can be formed, for example, from two beams detachably attached to permanent brackets 61 on one end wall 100 at an angle X such that the coil 104 is inclined in its erected position on a base 62, for example by arranging the beams so that they are capable of being introduced into hollow brackets 61 arranged on the outside 110A of one end wall 110 adjacent to one another and angled so that the resulting support 60 extends laterally for a considerable distance viewed along the ground 62, so as to provide secure erection on the ground, as shown in FIGS. 6 and 7, thereby permitting uncoiling of the cable 101, etc., from the outside without the need for the coil with the cable 101 wound on it to be rolled or lifted for each uncoiled turn.

Internal uncoiling, for example as shown in FIG. 7, of the desired amount of cable 101 can take place after the core for the coil has been replaced by an external connection 103 and/or 50. The essential requirement is for both end walls 107, 110 to be held together and distanced from one another in such a way that the entire cable skein 106 cannot be pulled off sideways as a collective unit, which would result in tangling and difficulties with the cable 101.

The invention is not restricted to the illustrative examples described above and illustrated in the drawings, but may be modified within the scope of the Patent Claims without departing from the idea of invention. The component parts of the coil may consist of metal, plastic or other fibrous material, for example aluminium, glass fibre or compressed board.

I claim:

1. An apparatus for coiling and uncoiling an elongated flexible element thereon, said flexible element having an outward and an inner end, said apparatus comprising:

at least one end wall having a centralized circular opening therein and a first and a second group of openings radially disposed from said central opening;

a first plurality of removable rod members disposed about said centralized opening wherein each respective rod is attached to said at least one end wall at each opening in said first group of openings, said rod members equidistantly spaced from each other, each of said rod members collectively forming a structurally open, centralized core for coiling said flexible element therearound, said core coextensive with said circular opening of said at least one end wall, said rod members retained in said at least one wall after said core is formed and when said flexible element is to be uncoiled; and a second plurality of removable rod members disposed about said centralized opening and wherein each respective rod of said second plurality is attached to said at least one end wall at each opening of said second group of openings, said second plurality of removable rod members attached to said end wall after said coil is formed, said second rod members for retaining and holding an outer edge of said coil.

2. The apparatus as claimed in claim 1, further including a second end wall having a central opening, each of said end walls attachable to one another through connection with the first and second plurality of rod members.

3. The arrangement as claimed in claim 2, wherein said first and second plurality of rods are adjustable movable in radially oriented mounting slots formed in exact locations in each of said end walls.

4. The arrangement as claimed in claim 2, wherein said two end walls are retained at a lateral distance from one another by the rod-shaped members, wherein at least one end of the rods includes a fastening means thereon for securing said end to an end wall.

5. The arrangement as claimed in claim 4, wherein at least one end of the rod-shaped members is threaded to accept a screwed-on fastener.

6. The arrangement as claimed in claim 1, wherein said second plurality of removable rod members comprise a connection which extends externally along a coiled elongated flexible element to retain the coil during uncoiling by its inner end.

7. The arrangement as claimed in claim 1, wherein an end wall is divided by a slot, said slot extending between said central opening and an outer edge of said end wall, the slot being covered with a bridging element.

8. An arrangement for coiling and uncoiling an elongated flexible element thereon, said flexible element having an outward and an inner end, said arrangement comprising:

at least one end wall having a centralized circular opening therein and a first and a second group of openings radially disposed from said central opening;

a first plurality of removable rod members disposed about said centralized opening wherein each respective rod is attached to said at least one end wall at each opening in said first group of openings, said rod members equidistantly spaced from each other, each of said rod members collectively forming a structurally open, centralized core for coiling said flexible element therearound, said core coextensive with said circular opening of said at least one end wall, said rod members retained in said at least one wall after said core is formed and when said flexible element is to be uncoiled;

a second plurality of removable rod members disposed about said centralized opening and wherein each respective rod of said second plurality is attached to said at least one end wall at each opening of said second group of openings, said second plurality of removable rod members attached to said end wall after said coil is formed, said second rod members for retaining and holding an outer edge of said coil; and a coiling arrangement rotatable about said core, said coiling arrangement for feeding said flexible element to said core for coiling thereabout, said coiling arrangement displaced radially outwards from said core and extending across a winding direction of said flexible element, said winding direction parallel to a direction of said first plurality of rods.

9. The system as claimed in claim 8, wherein said coiling arrangement is rotatable about the core such that said flexible element is extended axially in relation to the core before being fed for tangential delivery to the core.

* * * * *